US007435188B2

(12) United States Patent
Tateno et al.

(10) Patent No.: US 7,435,188 B2
(45) Date of Patent: Oct. 14, 2008

(54) GOLF PUTTER HEAD

(75) Inventors: Atsuo Tateno, Tokyo (JP); Yasunori Imamoto, Tokyo (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 202 days.

(21) Appl. No.: 11/313,619

(22) Filed: Dec. 22, 2005

(65) Prior Publication Data

US 2007/0049401 A1 Mar. 1, 2007

(30) Foreign Application Priority Data

Aug. 23, 2005 (JP) ..... P2005-241126

(51) Int. Cl.
*A63B 53/04* (2006.01)

(52) U.S. Cl. ..... 473/340; 473/345; 473/349

(58) Field of Classification Search ..... None
See application file for complete search history.

(56) References Cited

U.S. PATENT DOCUMENTS

| | | | | |
|---|---|---|---|---|
| 5,470,070 | A * | 11/1995 | Bendo | 473/252 |
| 5,482,281 | A | 1/1996 | Anderson | |
| 6,471,600 | B2 | 10/2002 | Tang et al. | |
| 6,663,497 | B2 | 12/2003 | Cameron | |
| 7,059,973 | B2 * | 6/2006 | Erickson et al. | 473/345 |
| 7,244,191 | B2 * | 7/2007 | Tang et al. | 473/335 |
| 2001/0029208 | A1 | 10/2001 | Takeda | |
| 2004/0045943 | A1 | 3/2004 | Yabu | |

FOREIGN PATENT DOCUMENTS

| | | | | |
|---|---|---|---|---|
| AT | 007 047 | U1 | | 9/2004 |
| JP | 8-196667 | A | | 8/1996 |
| JP | 11-137745 | A | | 5/1999 |
| JP | 2002-210049 | A | | 7/2002 |
| JP | 2003-52867 | A | | 2/2003 |
| JP | 2004-97276 | A | | 4/2004 |
| JP | 2004-222792 | A | | 8/2004 |
| JP | 2004-290565 | A | | 10/2004 |
| JP | 2004290565 | A | * | 10/2004 |
| JP | 2005124806 | A | * | 5/2005 |
| WO | WO 2004/078278 | A1 | | 9/2004 |

* cited by examiner

*Primary Examiner*—Gene Kim
*Assistant Examiner*—Alvin A Hunter
(74) *Attorney, Agent, or Firm*—Sughrue Mion, PLLC

(57) ABSTRACT

A golf putter head includes a hollow-structured body frame made of a metal material having a specific gravity of 4 to 9, which includes a face forming a recess, a crown forming in a center thereof a depression occupying at least 35% of an entire area of the crown, a toe, a heel, first and second sides extending backward from the toe and the heel respectively, a back connecting the first side and the second side, and a sole. A weight distribution is provided so that the toe, the heel, and the back are increased in wall thickness relative to a remaining portion. A face member made of a material having a specific gravity of 0.9 to 3 is attached to the recess of the face. A crown member made of the material having the specific gravity of 0.9 to 3 is attached to the depression of the crown.

3 Claims, 4 Drawing Sheets

GOLF PUTTER HEAD

BACKGROUND OF THE INVENTION

1. Field of the Invention

The present invention relates to a metal golf putter head having a hollow behind a face which hits a ball.

2. Description of the Related Art

The existing golf putter head generally decreases in volume when using a material having a relatively large specific gravity, such as stainless steel or copper alloy. Therefore, the putter head has a small inertia moment and thus a narrow sweet area, so that a roll distance is likely to vary due to variations in hitting point, which is not suitable for an average golfer. Thus, a so-called pin type putter head has been developed by increasing the wall thickness on the toe and heel sides and making the sweet area relatively large. However, since the pin type putter head has a narrow head width, there is the problem that vibration dampens quickly and a hitting feel is unlikely to remain in the hands, which makes it difficult to judge distance.

Therefore, a putter head has also been developed in which the head width is increased to improve a hitting feel, thus making it easy to judge distance. A representative example of the putter head having a wide head width is a so-called mallet type (e.g., see JP-A-2002-210049)

In an aluminum alloy single, mallet type golf putter head, which uses an aluminum alloy or the like of a relatively low specific gravity and is increased in head width, the specific gravity of a raw material (aluminum alloy) is too low, so that the aluminum alloy is used intact, i.e., without providing a hollow. Even when this aluminum alloy material is used for the golf putter head, in consideration of a weight balance, an adjustment is made using a large number of weights made of a material having a high specific weight. However, even when the aluminum alloy is used, this configuration is insufficient for functionally designing the golf putter head properly while increasing the head width to improve a hitting feel.

Even in the case of the mallet type golf putter head, which uses stainless used steel having a relatively high specific gravity and is provided with a hollow behind the face, in consideration of a weight balance, an adjustment is made by providing a weight in the hollow. However, this configuration is also insufficient for functionally designing the golf putter head properly while increasing the head width to improve a hitting feel.

SUMMARY OF THE INVENTION

The invention provides a mallet type golf putter head which can promote an increase in the size of a sweet area and the lowering and deepening of the center of gravity, and which can realize a satisfactory ball roll and a stable stroke path.

According to an aspect of the present invention, a golf putter head includes a hollow-structured body frame made of a metal material having a specific gravity of 4 to 9, which includes a face forming a recess, a crown forming in a center thereof a depression occupying at least 35% of an entire area of the crown, a toe, a heel, a first side extending backward from the toe, a second side extending backward from the heel, a back providing a connection between the first side and the second side, and a sole. A weight distribution is provided so that the toe, the heel, and the back are increased in wall thickness relative to a remaining portion. A face member made of a material having a specific gravity of 0.9 to 3 is attached to the recess of the face. A crown member made of the material having the specific gravity of 0.9 to 3 is attached to the depression of the crown.

According to this golf putter head of the invention, the mallet type golf putter head is configured such that the weight distribution is provided in which the toe, the heel, and the back, of the hollow-structured body frame made of a relatively high specific gravity metal material, is increased in wall thickness relative to the remaining portion, and the face member and the crown member, made of a relatively low specific gravity metal material, are attached to the recess formed in the face of this body frame and to the depression formed in the crown of this body frame. This can promote an increase in the size of a sweet area and the lowering and deepening of the center of gravity, which can realize a satisfactory ball roll and a stable stroke path.

DETAILED DESCRIPTION OF THE INVENTION

A preferred embodiment of the invention will hereafter be described with reference to the drawings.

Figure 1:
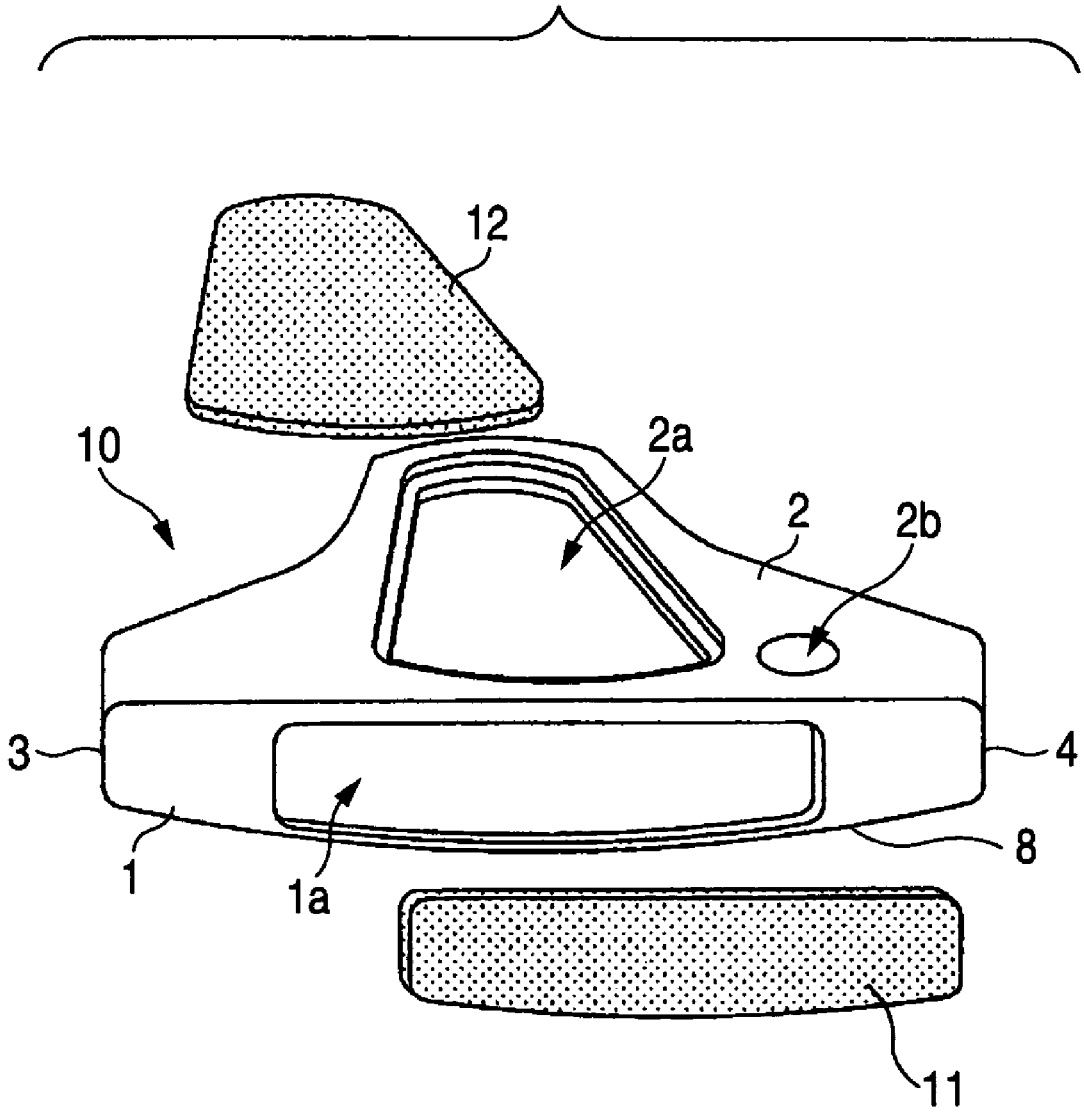
FIG. 1 is an assembly view of a golf putter head according to an embodiment of the invention.

FIG. 1 is an assembly perspective view of a golf putter head according the invention.

As shown in FIG. 1, the golf putter head of this embodiment is configured such that a face member 11 and a crown member 12, made of a low specific gravity metal material, are attached to a face 1 and a crown 2 of a hollow-structured body frame 10 made of a high specific gravity metal material.

A material having a specific gravity of 4 to 9 is preferable as a metal material used in the body frame 10. Specifically, titanium, its alloy, steel such as carbon steel, mar-aging steel, or stainless steel, and copper alloy such as brass, bronze, or beryllium copper are preferable.

A low specific gravity material having a specific gravity of 0.9 to 3 is preferable as a material used in the face member 11 to be attached to a recess 1*a* formed in the face 1 of the body frame 10, and used in the crown member 12 to be attached to a depression 2*a* formed in the crown 2. Specifically, carbon-fiber reinforced resin having a specific gravity of 1.4 to 1.5, aluminum alloy such as duralumin having a specific gravity of 2.7 to 2.8, and the like are preferable.

In this embodiment, the recess 1*a* is formed in the face 1 of the hollow-structured body frame 10 made of stainless used steel (SUS) having a specific gravity of 7.7 to 8, and the depression 2*a* is formed in the center of the crown 2. The face member 11 and the crown member 12, made of duralumin having a specific gravity of 2.7 to 2.8, are attached to the recess 1*a* and the depression 2*a*, respectively.

Figure 2A:
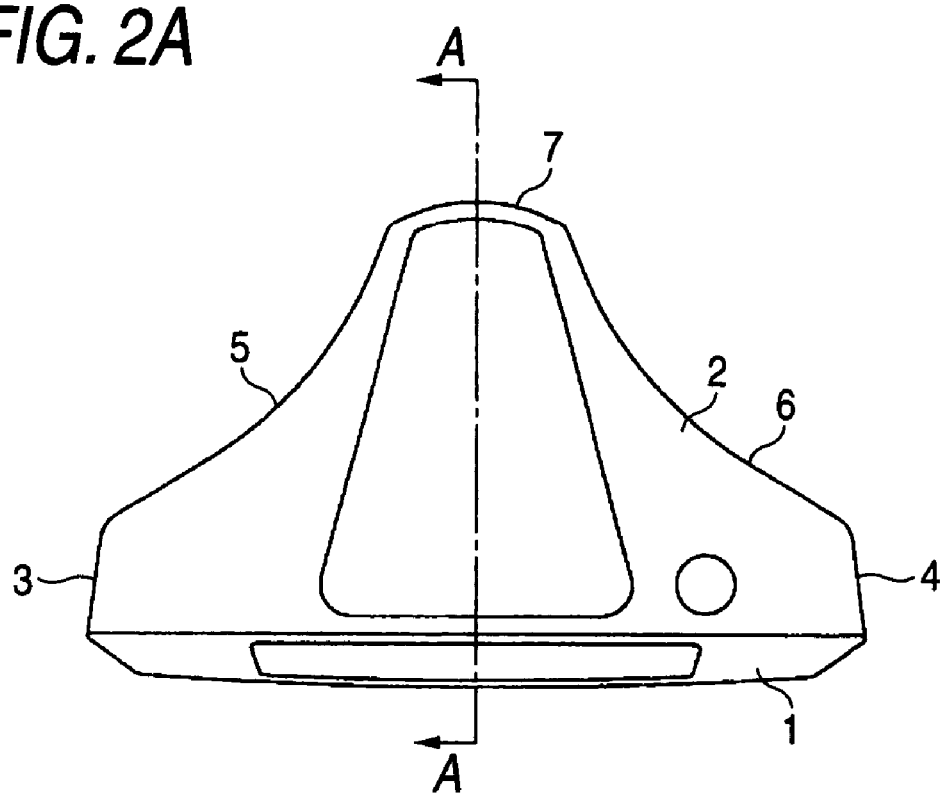
FIGS. 2A and 2B are a plan view and a sectional view of a body frame.
Figure 2B:
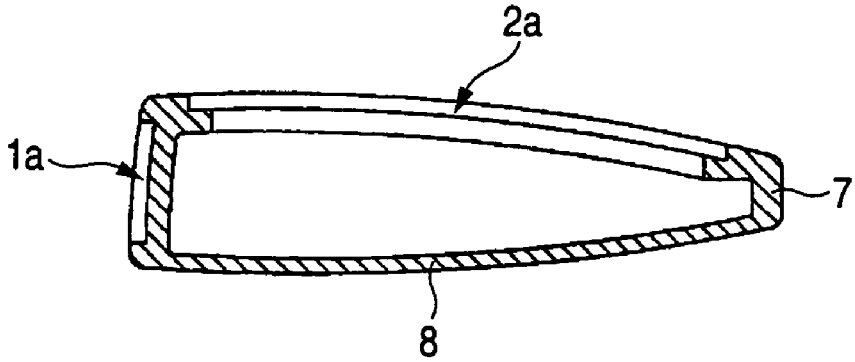
Figure 3:
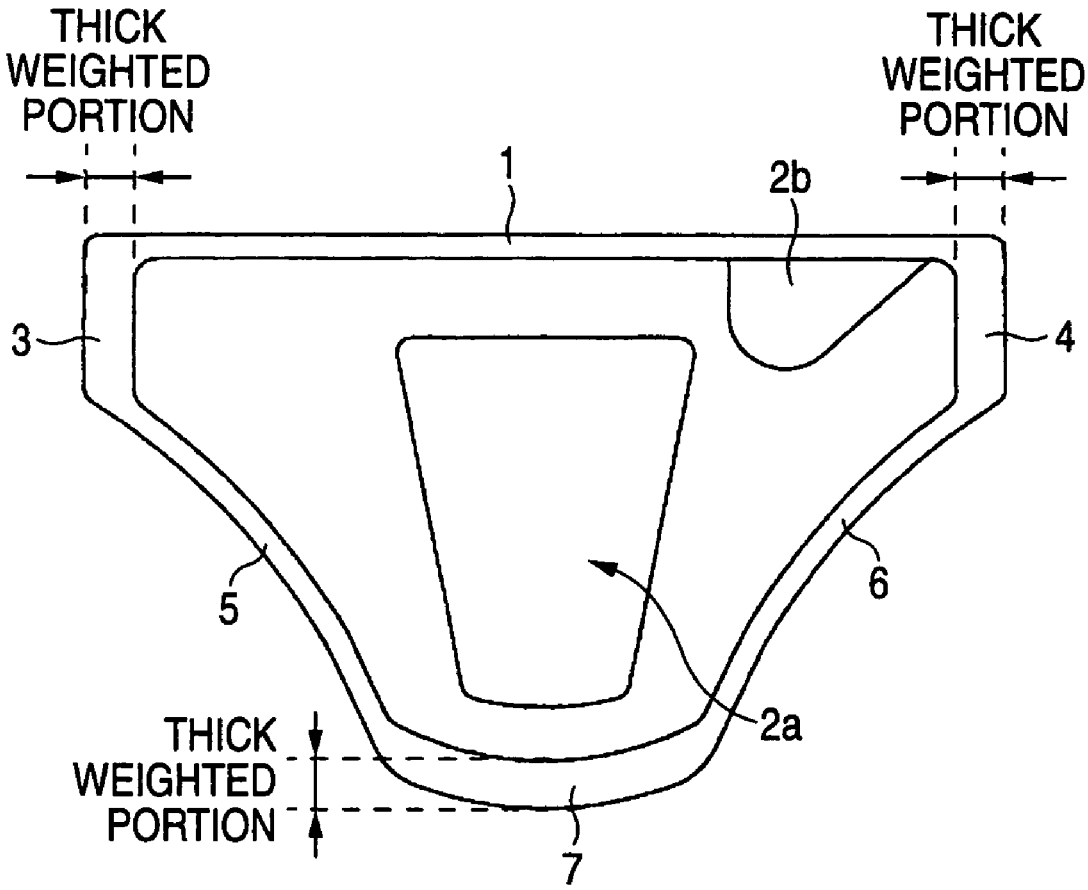
FIG. 3 is a bottom plan view of the body frame excluding a sole.

Referring to FIGS. 2 and 3, a description will be given of the hollow-structured body frame 10 made of a high specific gravity metal material (e.g., stainless used steel).

FIG. 2A is a plan view of the body frame 10, and FIG. 2B is a sectional view of the body frame 10 taken along line A-A of FIG. 2A.

As shown in FIGS. 2A and 2B, the hollow-structured body frame 10 made of a high specific gravity metal material includes the face 1, the crown 2, a toe 3, a heel 4, sides 5 and 6, a back 7, and a sole 8. The face 1 has the recess 1*a* for having attached thereto the face member 11 made of a low specific gravity material. The crown 2 has the depression 2*a* for having attached thereto the crown member 12 made of a low specific gravity material. The toe 3 and the heel 4 are generally vertical and extend a predetermined length backward from both ends (toe and heel) of the face 1. The sides 5 and 6 extend backward from the toe and the heel. The back 7 provides a connection between these sides.

The depression 2*a*, which occupies at least 35% of the entire area of the crown, is formed in the crown 2 of the top of the hollow-structured body frame made of a high specific gravity metal material. Preferably, a depression 2*a* occupying 40 to 60% of the entire area of the crown is formed in the center of the crown 2.

The crown member 12 made of a low specific gravity material is attached to this depression 2*a*.

In this embodiment, the hollow-structured body frame 10 having an overall wall thickness in the order of 2 mm is cast using stainless used steel having a specific gravity of 7.8 to 8.

In addition, the sole 8 of the body frame's bottom is cast separately from the main portion of the body frame 10 and later welded thereto, thus constructing the body frame 10.

Furthermore, in this embodiment, a hosel 2*b* which receives a shaft (not shown) is cast together with the body frame 10, and the depression 2*a* and the hosel 2*b* are formed in the crown 2 of the body frame's top.

A depression 2*a* occupying 100% of the entire area of the crown may be formed in the crown 2 of the body frame's top. In this case, the hosel 2*b* which receives the shaft is formed together with the crown member 12 made of a low specific gravity material. The crown member formed with the hosel is thus attached to this depression.

FIG. 3 is a bottom plan view showing the body frame 10 before the sole 8 welded to the bottom thereof.

As shown in FIG. 3, the hollow-structured body frame 10 is provided with a weight distribution in which the toe 3, the heel 4, and the back 7 are increased in wall thickness relative to the remaining portion. In other words, the weight distribution is provided in which the toe 3 and the heel 4, which are generally vertical and extend a predetermined length backward from both ends of the face 1, have increased wall thickness relative to the sides 5 and 6 inclined toward the back 7 from the toe 3 and the heel 4. And, the weight distribution is provided in which the back 7 has an increased wall thickness relative to the sides 5 and 6. The toe 3, the heel 4, and the back 7 are thus provided as the thick weighted portions of the hollow-structured body frame 10.

The sides 5 and 6, connected to the back 7 extending backward from the toe 3 and the heel 4, are inclined inward towards one another in the direction of the back 7 and bent inward to form a circular arc. The golf putter head can thereby be designed such that its center of gravity is positioned nearer the back 7, thus making it possible to deepen the center of gravity.

Figure 4A:
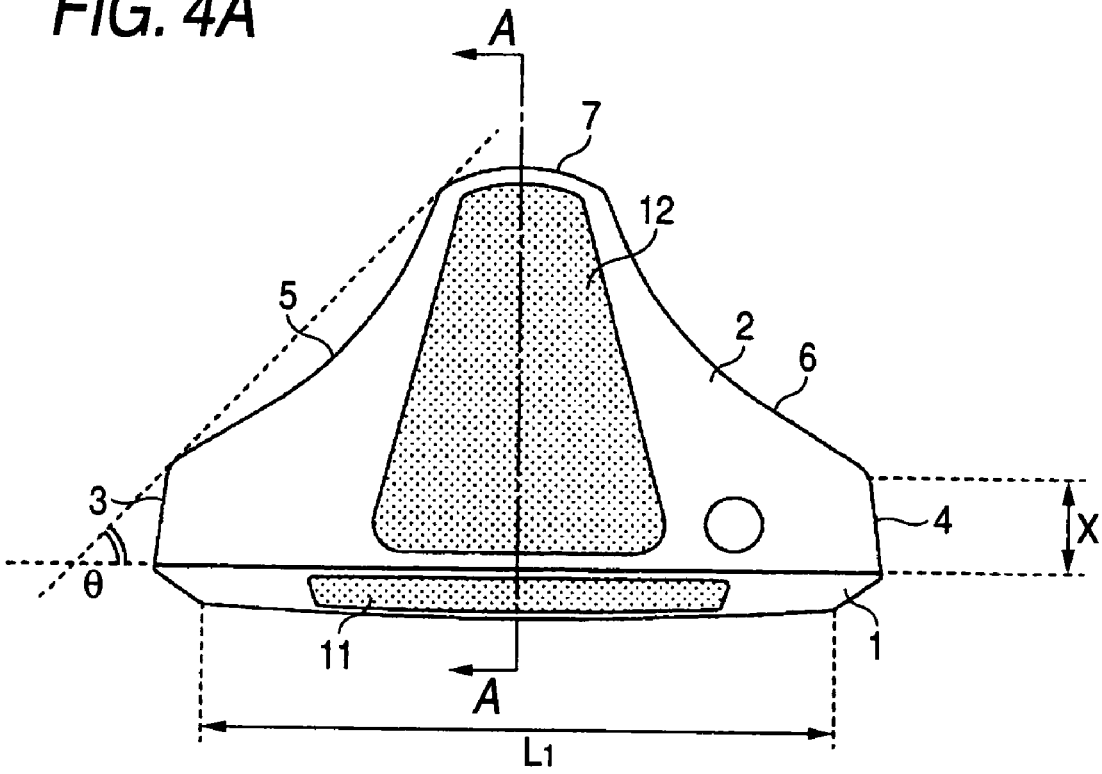
FIGS. 4A and 4B are a plan view and a sectional view of the golf putter head according to the embodiment of the invention.
Figure 4B:
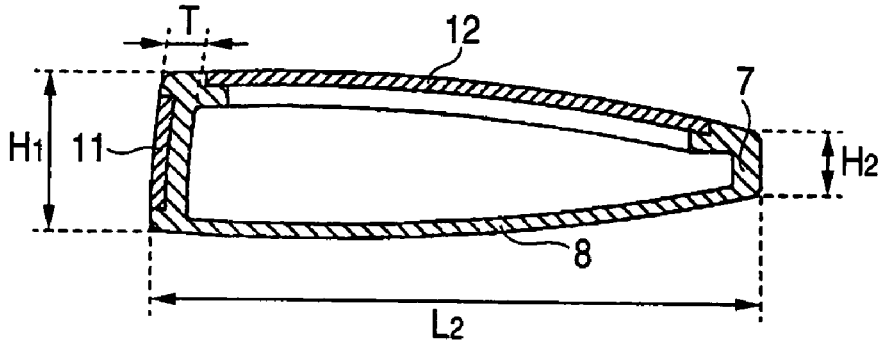

FIG. 4A is a plan view of the golf putter head, and FIG. 4B is a sectional view of the golf putter head taken along line A-A of FIG. 4A.

The golf putter head of the invention is configured as follows. As shown in FIG. 3, the hollow-structured body frame 10 is provided with the weight distribution in which the toe 3, the heel 4, and the back 7, of the hollow-structured body frame 10 having a high specific gravity metal material, are increased in wall thickness relative to the remaining portion. And, as shown in FIGS. 4A and 4B, the hollow-structured body frame 10 has the recess 1*a* obtained by reducing the wall thickness of the face 1 and the depression 2*a* formed to occupy at least 35% of the entire area of the crown. The face member 11 and the crown member 12, made of a low specific gravity material, are attached to such a hollow-structured body frame 10. This configuration can promote an increase in the size of a sweet area and the lowering and deepening of the center of gravity, thus making it possible to realize satisfactory ball roll and a stable stroke path.

In the golf putter head, wherein the depression 2*a* occupying 40 to 60% of the entire area of the crown is formed in the center of the crown 2 of the hollow-structured body frame 10 made of a high specific gravity metal material, and wherein the crown member 12 made of a low specific gravity material is attached to this depression 2*a*, the crown 2 of the top of this body frame is made of a high specific gravity metal material generally symmetrically on the toe and heel sides across the crown member 12. This crown 2 thus becomes higher in specific gravity on the toe and heel sides.

In other words, the crown member 12 made of a low specific gravity material is attached to the depression 2*a* formed in the center of the crown 2, and the crown 2 thereby becomes higher in specific gravity than the sole 8, which thus can lower the center of gravity. And, this crown 2 decreases in specific gravity in its center having the crown member 12 attached thereto, while it increases in specific gravity on the toe and heel sides across the crown member, and is thus weighted on the toe and heel sides, which can make the sweet area relatively large.

In this embodiment, a crown member 12 having a thickness in the order of 1.8 mm, made of duralumin having a specific gravity of 2.7 to 2.8, is attached to a generally trapezoidal depression 2*a* formed in the center of the crown 2 of the top of a body frame.

Additionally, a face 1 of the body frame is formed with a recess 1*a* obtained by reducing the wall thickness of the face 1, and a face member 11 having a thickness in the order of 2.0 mm, made of duralumin having a specific gravity of 2.7 to 2.8, is inserted into the recess 1*a*. The thickness (T) of the face 1, obtained by attaching the face member 11 to the recess 1*a*, is preferably 3.0 to 4.5 mm.

For example, in a golf putter head according to a first example of the invention, a hollow-structured body frame 10 having an overall wall thickness in the order of 2 mm is provided with the weight distribution in which a toe 3, a heel 4, and a back 7 have a wall thickness in the order of 3.5 mm (thick weighted portion).

And, the body frame 10 is designed as follows (see FIGS. 4A and 4B). That is, the length (X) of the toe 3 and the heel 4, which are generally vertical and extend backward from both ends of the face 1 is in a range of 15 to 30 mm (see FIG. 4A). Additionally, the gradient (θ) of sides 5 and 6, which extend from the toe 3 and the heel 4 and are then connected to the back 7, is in a range of 50 to 60 degrees. Furthermore, the ratio of the length (so-called face width) $L_1$ between the toe 2 and the heel 4 and the length (so-called head width) $L_2$ between the face 1 and the back 7 is $L_1:L_2=1:0.65$ to 0.8. The sides 5 and 6 inclined toward the back 7 from the toe 3 and the heel 4 are bent inward to form a circular arc.

In this example, the length X of the toe 3 and the heel 4 is set to be in the order of 20 mm, the face width $L_1$ is set to be in the order of 110 mm, the head width $L_2$ is set to be in the order of 85 mm, and the gradient θ of the sides 5 and 6 is set to be in the order of 56 degrees. Additionally, the thickness T of the face 1 obtained by inserting into a recess 1*a* a face member 11 having a thickness in the order of 2.0 mm, made of duralumin, is set to be in the order of 3.5 mm. Furthermore, the height $H_1$ of this face 1 is set to be in the order of 27 mm, and the height $H_2$ of the back 7 is set to be in the order of 10 mm. Thus, the face member 11 and a crown member 12, made of duralumin, are attached to the hollow-structured body frame 10 made of stainless used steel, thereby acquiring a golf putter head having a volume of 145 ml and a weight of 350 g.

In a golf putter head according to a second example of the invention, a hollow-structured body frame 10 having an overall wall thickness in the order of 2 mm is provided with the weight distribution in which a toe 3, a heel 4, and a back 7 have a wall thickness in the order of 4.5 mm (thick weighted portion).

And, the body frame 10 is designed as follows (see FIGS. 4A and 4B). That is, the length (X) of the toe 3 and the heel 4, which are generally vertical and extend backward from both ends of the face 1 is in a range of 15 to 30 mm (see FIG. 4A). Additionally, the gradient (θ) of sides 5 and 6, which extend from the toe 3 and the heel 4 and are then connected to the back 7, is in a range of 35 to 50 degrees. Furthermore, the ratio of the length (so-called face width) $L_1$ between the toe 2 and the heel 4 and the length (so-called head width) $L_2$ between the face 1 and the back 7 is $L_1$:$L_2$=1:0.4 to 0.65. The sides 5 and 6 inclined toward the back 7 from the toe 3 and the heel 4 are bent inward to form a circular arc.

In this example, the length X of the toe 3 and the heel 4 is set to be in the order of 20 mm, the face width $L_1$ is set to be in the order of 110 mm, the head width $L_2$ is set to be in the order of 70 mm, and the gradient θ of the sides 5 and 6 is set to be in the order of 49 degrees. Additionally, the thickness T of the face 1 obtained by inserting into a recess 1*a* a face member 11 having a thickness in the order of 2.0 mm, made of duralumin, is set to be in the order of 3.5 mm. Furthermore, the height $H_1$ of this face 1 is set to be in the order of 27 mm, and the height $H_2$ of the back 7 is set to be in the order of 15 mm. Thus, the face member 11 and a crown member 12, made of duralumin, are attached to the hollow-structured body frame 10 made of stainless used steel, thereby providing a golf putter head having a volume of 130 ml and a weight of 350 g.

As in the golf putter head according to this embodiment of the invention, the weight distribution is provided in which the toe 3, the heel 4, and the back 7, of the hollow-structured body frame 10 made of a high specific gravity metal material, are increased in wall thickness relative to the remaining portion. And, the face member 11 made of a low specific gravity material is attached to the face 1. This can increase the size of a sweet area and deepen the center of gravity.

In addition, the depression 2*a* is formed in the center of the crown 2 to occupy 35% of the entire area of the crown, and the crown member 12 made of a low specific material is attached to this depression 2*a*. It thereby follows that the crown 2 having the crown member 12 attached thereto is lighter than the sole 8 made of a high specific gravity metal material. Therefore, this can lowers the center of gravity.

The golf putter head is easy to swing, having a head weight (mass) in the order of 300 to 380 g.

In addition, the volume of the golf putter head is preferably set to be in the order of 90 to 300 ml. This range provides a head size which is easy for a golfer to handle, and makes it possible to attain a sufficiently large value of the inertia moment around the center of gravity of the head. Less than 90 ml is not suitable. If the head volume is too small, the inertia moment around the center of gravity of the head becomes small, and when the golfer barely misses the sweet area, the roll distance becomes shorter than expected. Conversely, in the case of more than 300 ml, when the golfer is ready to hit the ball, as the head volume is too large, the golfer has difficulty determining which portion of the face surface should strike the ball. Such a putter rather makes it difficult for the golfer to judge distance.

The golf putter head according to the embodiment of the invention is set to have a volume of 130 to 145 ml.

Additionally, the length (so-called head width) $L_2$ between the face 1 and the back 7 is set to be within a range of 30 to 150 mm. When the maximum value of the head width $L_2$ is less than 30 mm, the inertia moment around the central axis of the head becomes small. When the head width decreases, the vibration generated when the ball is hit dampens immediately, and a hitting feel is unlikely to remain in the hands. Such a golf putter head makes it difficult for the golf player to judge distance.

When the head width L2 exceeds 150 mm, the sole width also increases. In the case of an approach using a putter from around a green, therefore, such a golf putter head is likely to duff a ball and is thus difficult to handle.

What is claimed is:

1. A golf putter head comprising a hollow-structured body frame made of a metal material having a specific gravity of 4 to 9, the hollow-structured body frame including:

a face forming a recess;

a crown forming in a center thereof a depression occupying at least 35% of an entire area of the crown;

a toe;

a heel;

a first side extending backward from the toe;

a second side extending backward from the heel;

a back providing a connection between the first side and the second side; and a sole, wherein a weight distribution is provided so that the toe, the heel, and the back are increased in wall thickness relative to a remaining portion, a face member made of a material having a specific gravity of 0.9 to 3 is attached to the recess of the face, and a crown member made of the material having the specific gravity of 0.9 to 3 is attached to the depression of the crown, wherein the crown member further comprises an outer edge, such outer edge being covered by the body frame.

2. A golf putter head comprising a hollow-structured body frame made of a metal material having a specific gravity of 4 to 9, the hollow-structured body frame including:

a face forming a recess;

a crown forming in a center thereof a depression occupying at least 35% of an entire area of the crown;

a toe;

a heel;

a first side extending backward from the toe;

a second side extending backward from the heel;

a back providing a connection between the first side and the second side; and a sole, wherein a weight distribution is provided so that the toe, the heel, and the back are increased in wall thickness relative to a remaining portion, a face member made of a material having a specific gravity of 0.9 to 3 is attached to the recess of the face, and a crown member made of an aluminum alloy is attached to the depression of the crown, wherein the crown member further comprises an outer edge, such outer edge being covered by the body frame.

3. A golf putter head comprising a hollow-structured body frame made of a metal material having a specific gravity of 4 to 9, the hollow-structured body frame including:

a crown forming in a center thereof a depression occupying at least 35% of an entire area of the crown;

a toe;

a heel;

a first side extending backward from the toe;

a second side extending backward from the heel;

a back providing a connection between the first side and the second side; and a sole, wherein a weight distribution is provided so that the toe, the heel, and the back are increased in wall thickness relative to a remaining portion, and a crown member made of the material having the specific gravity of 0.9 to 3 is attached to the depression of the crown, wherein the crown member further comprises an outer edge, such outer edge being covered by the body frame.

* * * * *